United States Patent [19]

Bell et al.

[11] 3,968,923

[45] July 13, 1976

[54] HOLLOW WALL CARTON CORNER ARRANGEMENT

[75] Inventors: Richard L. Bell, Phoenixville; Richard T. Walter, Norristown, both of Pa.

[73] Assignee: Container Corporation of America, Chicago, Ill.

[22] Filed: July 28, 1975

[21] Appl. No.: 599,668

[52] U.S. Cl. ..... 229/34 HW; 229/34 R

[51] Int. Cl.[2] ..... B65D 5/22

[58] Field of Search ..... 229/34 R, 34 HW

[56] References Cited

UNITED STATES PATENTS

| | | | |
|---|---|---|---|
| 2,283,950 | 5/1942 | Ringler | 229/34 R |
| 2,768,776 | 10/1956 | Weiss | 229/34 R X |
| 2,846,133 | 3/1958 | Burden | 229/34 R |
| 2,914,235 | 11/1959 | Jones | 229/34 R |
| 2,983,428 | 5/1961 | Bess | 229/34 HW |
| 3,499,597 | 3/1970 | Katzman | 229/34 HW |
| 3,756,499 | 9/1973 | Giebel et al | 229/34 R |

*Primary Examiner*—Davis T. Moorhead

*Attorney, Agent, or Firm*—Carpenter & Ostis

[57] ABSTRACT

A reinforced corner construction for a hollow wall, tray-type paperboard carton having, opposed pairs of hollow side walls, corner flaps extending from the ends of each side wall to the adjacent side wall, and reinforcing panels on the corner flaps.

5 Claims, 6 Drawing Figures

HOLLOW WALL CARTON CORNER ARRANGEMENT

SUMMARY OF THE INVENTION

The invention relates to tray-type cartons having opposed pairs of side walls, each including an inner and outer panel joined by a top panel, and having corner flaps extending from the ends of each side wall and connected to the ends of adjacent side walls.

It is an object to provide, in a carton of this type, a reinforced corner construction of relatively simple design and construction.

A more specific object of the invention, in a carton of the type described, is a corner construction which includes a reinforcing panel foldably joined to the corner flap extending from each side wall and being interposed between the inner and outer panels of an adjacent side wall. These and other objects of the invention will be apparent from an examination of the following description and drawings.

THE DRAWINGS

It will be understood that, for purposes of clarity, certain elements may have been omitted from certain views where they are believed to be illustrated to better advantage in other views.

Figure 1:
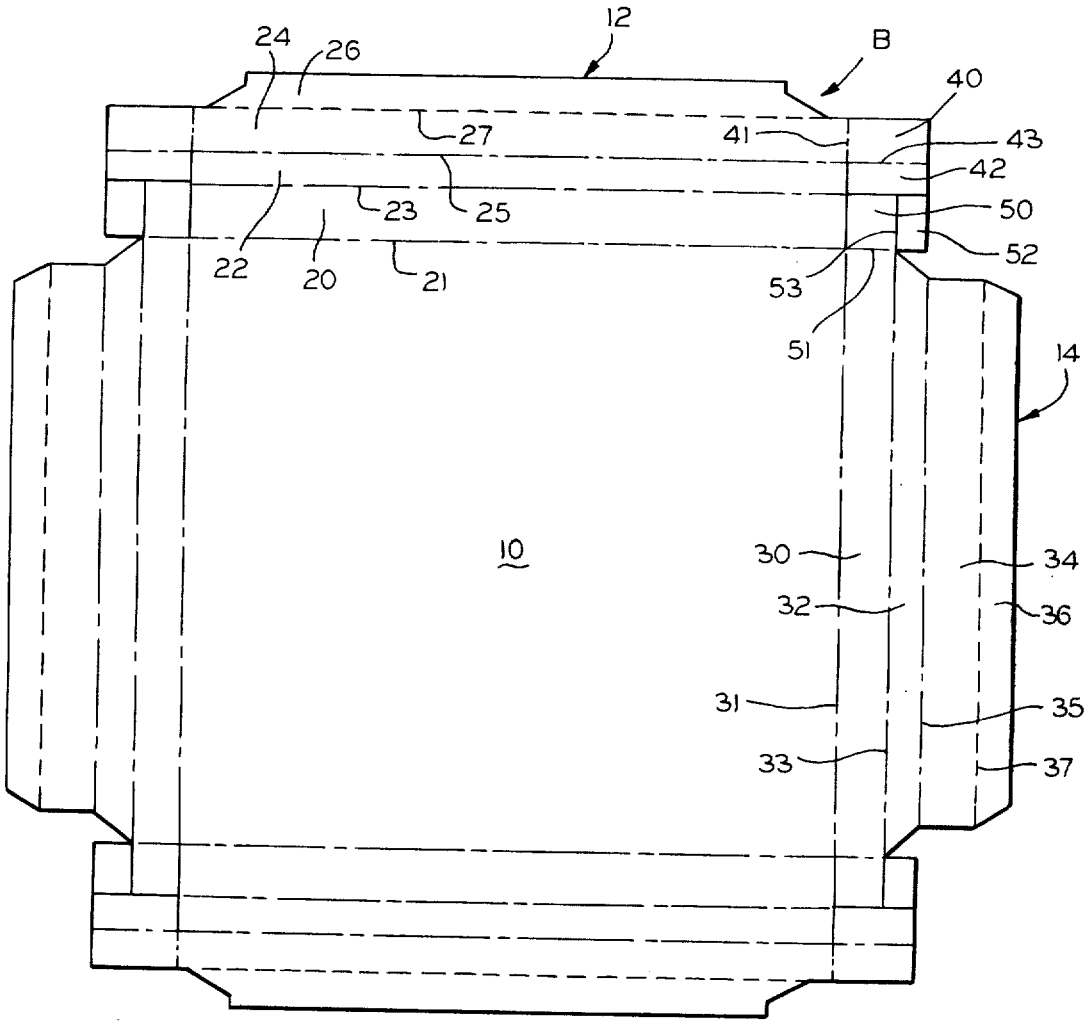
FIG. 1 is a plan view of a blank of foldable paperboard from which the carton illustrated in FIGS. 2 and 3 may be formed.
Figure 2:
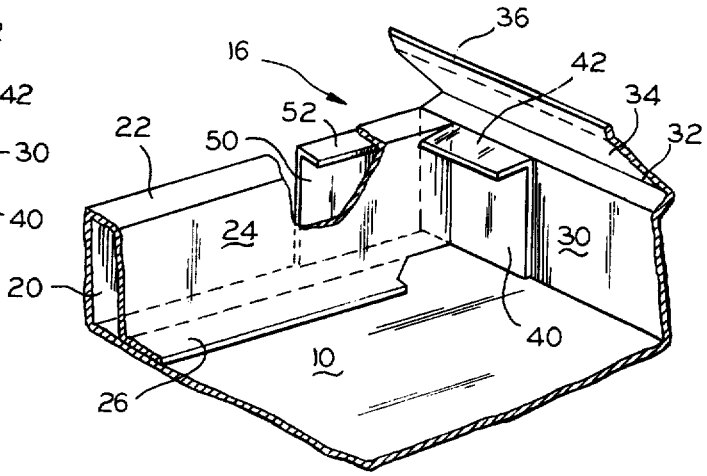
FIG. 2 is a fragmentary perspective view of a corner of a carton embodying features of the invention, with the structure shown in a partially erected condition.

Referring now to the drawings for a better understanding of the invention, it will be seen that the carton embodying features of the invention is an open-top, hollow wall, tray-type carton, one corner of which is illustrated in FIG. 2. This carton may be formed from a unitary blank of paperboard or the like indicated generally at B and illustrated in FIG. 1 of the drawings.

The carton includes a preferably rectangular, flat bottom wall 10 having opposed pairs of first and second side walls, indicated generally at 12 and 14, respectively, upstanding therefrom and having their adjacent ends interlockingly connected at the corners of the carton in a corner construction arrangement indicated generally at 16 and best seen in FIG. 2.

Each of the side walls 12 of the first pair includes an outer panel 20 foldably connected at its lower edge along a fold line 21 to related side edge of bottom wall 10; a top panel 22 foldably connected at its outer edge along fold line 23 to the upper edge of outer panel 20; and inner panel 24 foldably connected at its upper edge along fold line 25 to the inner edge of top panel 22; and a retaining flap 26 foldably connected at its outer edge along fold line 27 to the lower edge of inner panel 24 and preferably secured to the upper surface of bottom wall 10 in full-face engagement therewith.

Each of the side walls 14 of the second pair has a similar construction and includes an outer panel 30, a top panel 32, an inner panel 34, and a retaining flap 36 which are foldably connected to the related portions of the structure along fold lines 31, 33, 35, and 37, respectively.

Now turning to the specific corner arrangement of the carton wherein the novelty of the invention resides, it will be seen that each of the first side walls 12 includes a pair of first corner flaps 40 foldably connected along fold lines 41 to the opposite ends of first side wall inner panel 24. Foldably connected to each of the first side wall corner flaps 40 is a reinforcing panel 42 which is foldably connected to a side edge of flap 40 along a fold line 43 which extends in a direction normal to fold line 41 and is in substantial alignment with fold line 25.

Likewise, each side wall 14 of the second pair includes, at each end thereof, a second corner flap 50 foldably connected along fold line 51 to the end edge of the second side wall outer panel 30 and having attached to a side edge thereof along fold line 53, which extends in a direction normal to fold line 51, a reinforcing panel 52.

As best seen in FIG. 2, when the carton is erected, the corner flaps of each side wall are folded at right angles to their respective side walls and interposed between the inner and outer panels of the adjacent side wall. Thus, first side wall corner flap 40 is disposed in full-face engagement with and secured to the inner surface of second side wall outer panel 30, and, at the same time, second side wall corner flap 50 is secured to the inner surface of first side wall outer panel 20. Each of the reinforcing panels 42 and 52 are folded at right angles to their respective corner flaps so as to lie in a horizontal plane directly beneath the top panels of the adjacent side walls to provide additional rigidity for the corner construction of the carton.

It is contemplated that the carton would be shipped in a flat condition, as shown in FIG. 1, to the consumer who, prior to filling the carton with its product, would erect the carton by a machine containing internal and/or external heat sealing dies which would apply pressure and heat to the corners of the carton to cause the retaining flaps to be bonded to the bottom wall of the carton and also to cause the corner flaps to be bonded to the side wall outer panels of the carton. The reinforcing panels not only serve to provide additional rigidity after the carton has been formed, but they also provide structural rigidity during the formation and heat sealing of the carton side wall structure.

Figure 3:
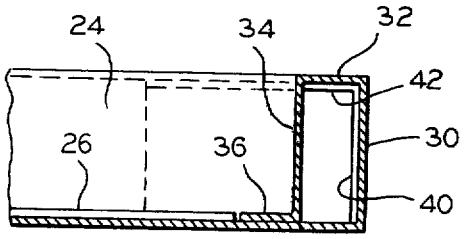
FIG. 3 is a transverse, vertical section of the structure illustrated in FIG. 2.
Figure 4:
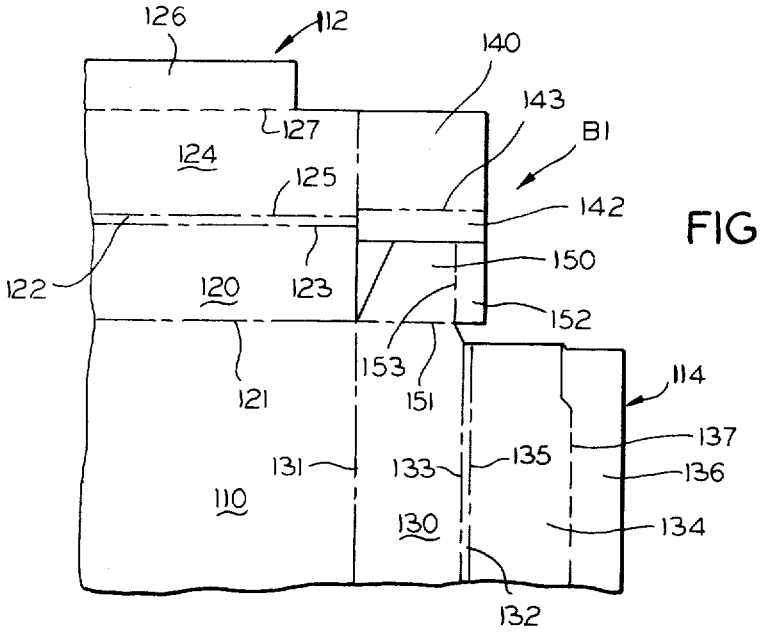
FIGS. 4 through 6 are views similar to FIGS. 1 through 3, respectively, but illustrating a modified form of the invention.
Figure 5:
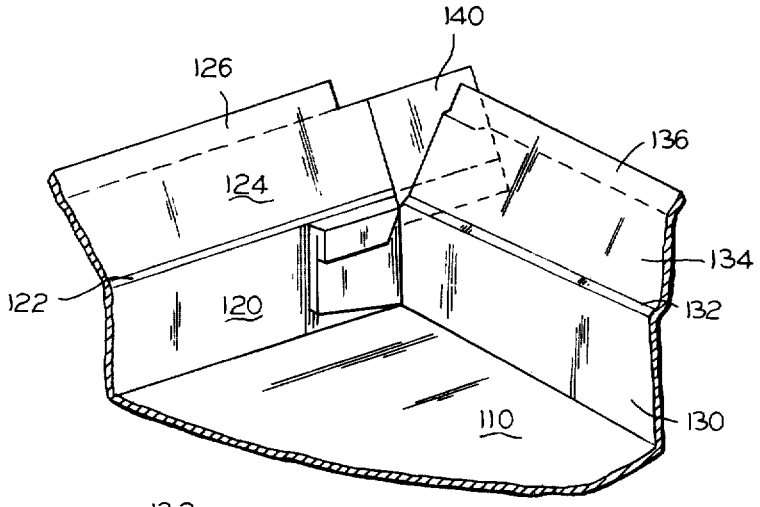
Figure 6:
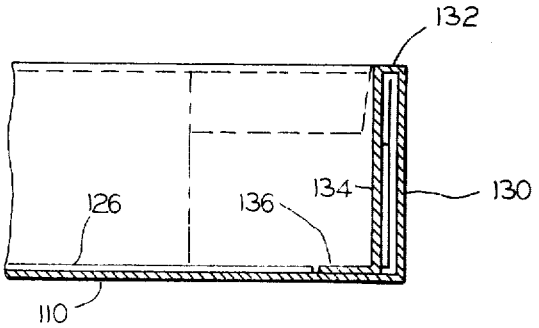

Referring now to FIGS. 4 through 6 of the drawings, it will be seen that a slightly modified form of the invention is shown. The structure illustrated in these views is basically the same as the structure of FIGS. 1 through 3, except that the thickness of the outer walls is substantially less than in the previous embodiment. In this embodiment, portions of the structure corresponding to similar portions of the structure of the first embodiment have been identified by similar numerals and will not be described in great detail in connection with this embodiment.

As best seen in FIG. 4, top panels 122 and 132 of first and second side walls 112 and 114, respectively, are relatively narrow in width. Also in this embodiment, reinforcing panels 142 and 152, instead of being disposed to extend in a direction normal to their respective corner flaps 140 and 150, are folded inwardly 180° so as to lie in full-face engagement with their respective corner flaps. Thus, when the carton is sealed, the inner and outer panels, the corner flaps, and the reinforcing flaps may all be bonded together by the heat sealing operation.

It is understood, of course, that in each embodiment the paperboard blank is coated with a wax or plastic material which lends itself to a heat sealing operation. If for some reason or other it is desired not to heat seal the carton, conventional adhesives could be used to secure the related portions of the structure together in the same manner as previously described.

Again, in connection with the embodiment illustrated in FIGS. 4 through 6, the function of the auxiliary or reinforcing flaps 142 and 152 is to afford additional rigidity for the carton, not only when the carton is in the erected condition, but also to provide additional structural rigidity during the formation and heat sealing of the carton side wall structure.

We claim:

1. In a reinforced, interlocking, corner construction arrangement for a hollow wall carton formed from a unitary blank of foldable paperboard, the combination of:

a. a bottom wall;

b. opposed pairs of hollow first and second side walls upstanding from said bottom wall and joined to each other at the corners of said carton to form a tray open at the top;

c. each of said side walls being hollow and comprising:

i. an outer panel foldably connected at its lower edge to a related side edge of said bottom wall;

ii. a top panel foldably connected at its outer edge to the upper edge of said outer panel;

iii. an inner panel foldably connected at its upper edge to the inner edge of said top panel;

iv. a retaining flap foldably connected at its outer edge to the lower edge of said inner panel, and disposed in full-face engagement with said bottom wall;

d. a first corner flap foldably connected at one edge to an end of said first wall inner panel, and having a reinforcing panel foldably connected thereto along a side edge extending normal to said one edge thereof;

e. a second corner flap foldably connected at one edge to an end of said second wall outer panel, and having a reinforcing panel foldably connected thereto along a side edge extending normal to said one edge thereof;

f. said first corner flap being folded normal to said first wall inner panel and being secured in full-face engagement to the inner surface of said second side wall outer panel;

g. said first corner flap reinforcing panel being interposed between the inner and outer panels of said second side wall to provide added rigidity for said second side wall;

h. said second corner flap being folded normal to said second wall outer panel and being secured in full-face engagement to the inner surface of said first side wall outer panel;

i. said second corner flap reinforcing panel being interposed between the inner and outer panels of said first side wall to provide added rigidity for said first side wall.

2. An arrangement according to claim 1, wherein said retaining flaps are secured to the upper surface of said bottom wall.

3. An arrangement according to claim 1, wherein the corner flap reinforcing panel of each side wall is folded normal to its corner flap so as to underlie the top panel of the adjacent side wall.

4. An arrangement according to claim 1, wherein the corner flap reinforcing panel of each side wall is folded inwardly 180° so as to lie in full-face engagement with the inner surface of its corner flap.

5. An arrangement according to claim 4, wherein said reinforcing panel is secured to said corner flap and to the outer surface of the inner panel of the adjacent side wall.

* * * * *